US010818277B1

(12) United States Patent
Mancini

(10) Patent No.: US 10,818,277 B1
(45) Date of Patent: Oct. 27, 2020

(54) ENHANCED ELECTRONIC MUSICAL WIND INSTRUMENT

(71) Applicant: ARTINOISE S.R.L., Tolentino (IT)

(72) Inventor: Davide Mancini, Senigallia (IT)

(73) Assignee: ARTINOISE S.R.L., Tolentino (MC) (IT)

( * ) Notice: Subject to any disclaimer, the term of this patent is extended or adjusted under 35 U.S.C. 154(b) by 0 days.

(21) Appl. No.: 16/587,981

(22) Filed: Sep. 30, 2019

(51) Int. Cl.
*G10H 3/00* (2006.01)
*G10H 1/00* (2006.01)
*G10H 1/34* (2006.01)
*G10H 7/00* (2006.01)

(52) U.S. Cl.
CPC ..... *G10H 1/0008* (2013.01); *G10H 1/34* (2013.01); *G10H 7/008* (2013.01); *G10H 2220/361* (2013.01); *G10H 2220/395* (2013.01); *G10H 2240/321* (2013.01); *G10H 2250/461* (2013.01)

(58) Field of Classification Search
CPC ..... G10H 1/00; G10H 2220/521; G10H 2220/525; G10H 2210/066; G10H 2220/561
See application file for complete search history.

(56) References Cited

U.S. PATENT DOCUMENTS 5,125,315 A * 6/1992 Kawashima ..... G10H 1/20 84/619
5,403,966 A * 4/1995 Kawashima ..... G10H 1/0553 84/612
5,922,985 A * 7/1999 Taniwaki ..... G10H 1/34 84/742
5,929,361 A * 7/1999 Tanaka ..... G09B 15/003 84/380 R
6,002,080 A * 12/1999 Tanaka ..... G10D 7/00 84/609
6,326,532 B1 * 12/2001 Antaki ..... G10D 7/14 84/377
2003/0209131 A1 * 11/2003 Asahi ..... G09B 15/023 84/485 R
2005/0056139 A1 * 3/2005 Sakurada ..... G10H 5/005 84/616
2005/0076774 A1 * 4/2005 Sakurada ..... G10H 1/0016 84/616
2006/0283312 A1 * 12/2006 Shibata ..... G10H 1/34 84/724
2007/0017346 A1 * 1/2007 Masuda ..... G10H 5/007 84/600
2007/0227343 A1 * 10/2007 Sawada ..... G10D 7/08 84/723
2007/0234887 A1 * 10/2007 Sawada ..... G10D 9/04 84/723
2008/0017014 A1 * 1/2008 Suzuki ..... G10C 3/00 84/385 R (Continued)

*Primary Examiner* — Marlon T Fletcher
(74) *Attorney, Agent, or Firm* — Egbert, McDaniel & Schwartz, PLLC

(57) ABSTRACT

A musical instrument includes a hollow body with an air inlet to blow air into the body, and an air outlet to allow the air to exit the body. A number of holes are provided which are suitable to be closed by a player. A sensor group includes proximity sensors located near the holes to detect if the holes are closed or open. One control unit is electrically connected to the sensor group, and power supply unit is connected to the sensor group and the control unit to power up the sensor group and the control unit.

21 Claims, 5 Drawing Sheets

(56) References Cited

U.S. PATENT DOCUMENTS

| | | | | |
|---|---|---|---|---|
| 2009/0019999 | A1* | 1/2009 | Onozawa | G10H 1/34 84/658 |
| 2009/0020000 | A1* | 1/2009 | Onozawa | G10H 1/32 84/723 |
| 2009/0038463 | A1* | 2/2009 | Fujii | G10D 9/03 84/398 |
| 2013/0014631 | A1* | 1/2013 | Grace | G10D 7/026 84/454 |

* cited by examiner

ENHANCED ELECTRONIC MUSICAL WIND INSTRUMENT

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a perfected and enhanced musical instrument. Particularly, the present invention relates to an enhanced wind musical instrument.

2. Description of Related Art Including Information Disclosed Under 37 CFR 1.97 And 37 CFR 1.98

In the well known class of wind musical instruments there are some families including (but not limited to): recorders, transverse flutes, saxophones, oboes etc. In particular, the recorder, is an easy to learn and relatively cheap instrument. A less than expert user can learn quickly how to play the recorder and for this reason it is widely used in primary and secondary schools for musical education.

Wind instruments are musical instruments where the player blows air into it and it becomes the element that vibrates and producing sounds. As with any wind instrument, air pressure, coming from the mouth of the player, has to be precisely calibrated to produce either pleasing and in-tune sounds. Normally, during the learning process, the new user finds it difficult to achieve this, due to the nature of the instrument and its cheap construction.

The limitation in the easiness of producing sounds pleasing to the ear, it is the first reason, in many cases, of a quick loss of interest in the learning and playing of the instrument. In a worst case scenario, it can lead to a total aversion to the instrument and then to the refusal to continue the learning process, losing the opportunity to develop interest and passion to playing music on any instrument.

To partially solve this problem, electronic wind instruments have been created that include controls to modify (and enhance) the production of sounds to allow the learning player to receive positive stimuli and reach good results that will boost the interest in this activity.

Electronic wind instruments are very expensive due to the involved technology and difficulty in implementation of the specific manufacturing processes.

This level of cost is particularly difficult to approach and when the player loses interest in the instrument's learning.

For those reasons, an electronic wind instrument as available today, is only appealing to professional musicians.

BRIEF SUMMARY OF THE INVENTION

The aim of the present invention is to overcome the limitations of the existing products, implementing an electronic wind instruments that is both low in cost and easy to use.

Another key target of the present invention is to create an electronic musical instrument that is versatile and that can be used not only as a wind instrument but also like other musical instruments.

Another scope of this invention is to create an electronic musical instrument that can communicate with a smart device to elaborate further the notes played with the instrument, stimulating creativity and connection to other players in real-time or off-line.

Those intentions are met according to the invention with the characteristics indicated in the claim number 1. The electronic musical instrument that is the object of the invention is defined in claim number 1.

Advantageous embodiments of the invention will appear from the dependent claims.

BRIEF DESCRIPTION OF THE SEVERAL VIEWS OF THE DRAWINGS

To achieve better understanding, the description of the electronic wind instrument, according to the present invention, continue referencing the figures, that have descriptive but not limitative value, where.

DETAILED DESCRIPTION OF THE INVENTION

Figure 1:
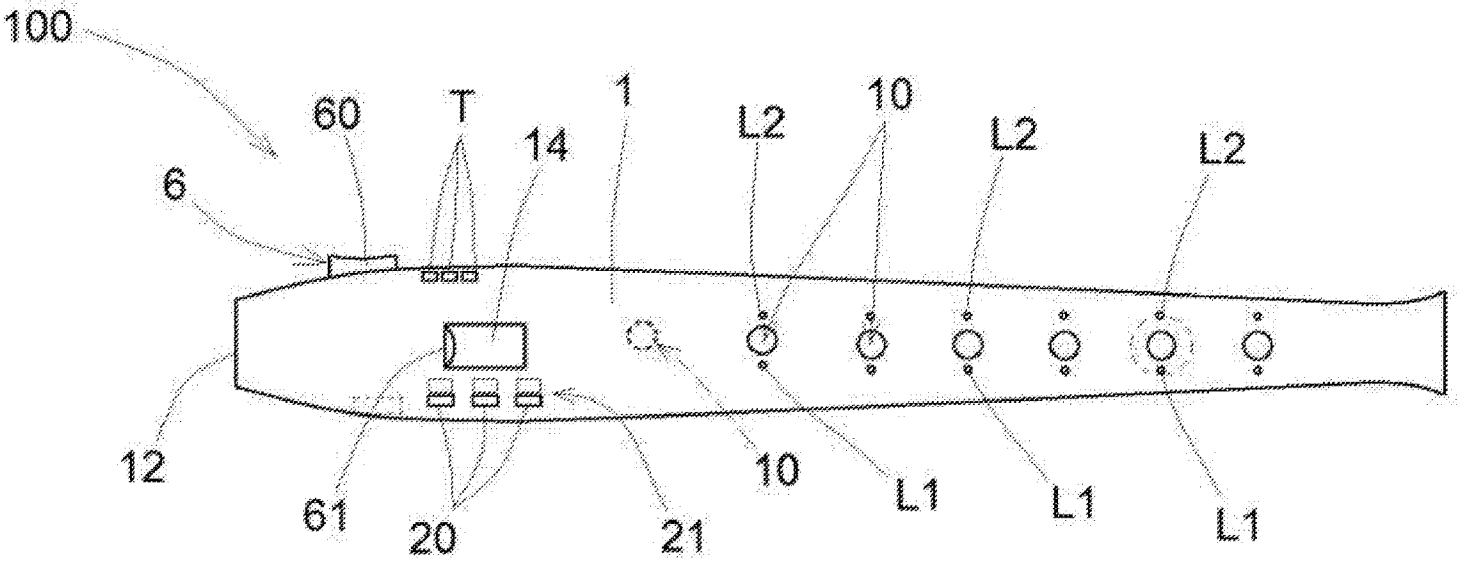
FIG. 1 is a top view of the musical instrument of the present invention.
Figure 2:
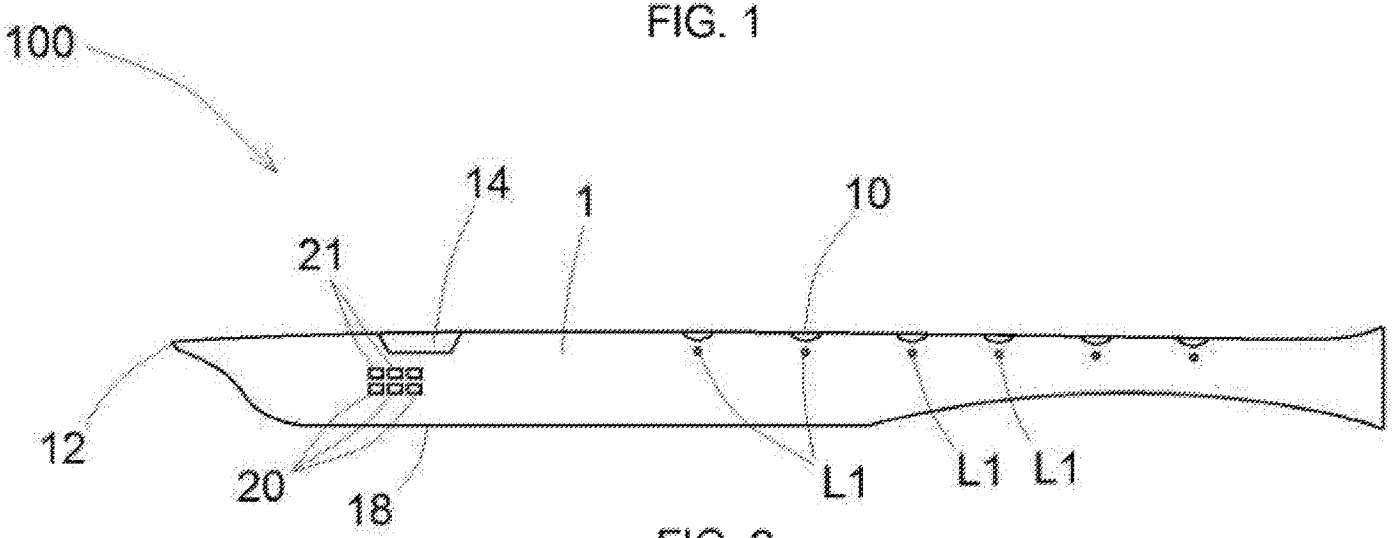
FIG. 2 is a lateral view of the musical instrument of the present invention.
Figure 5:
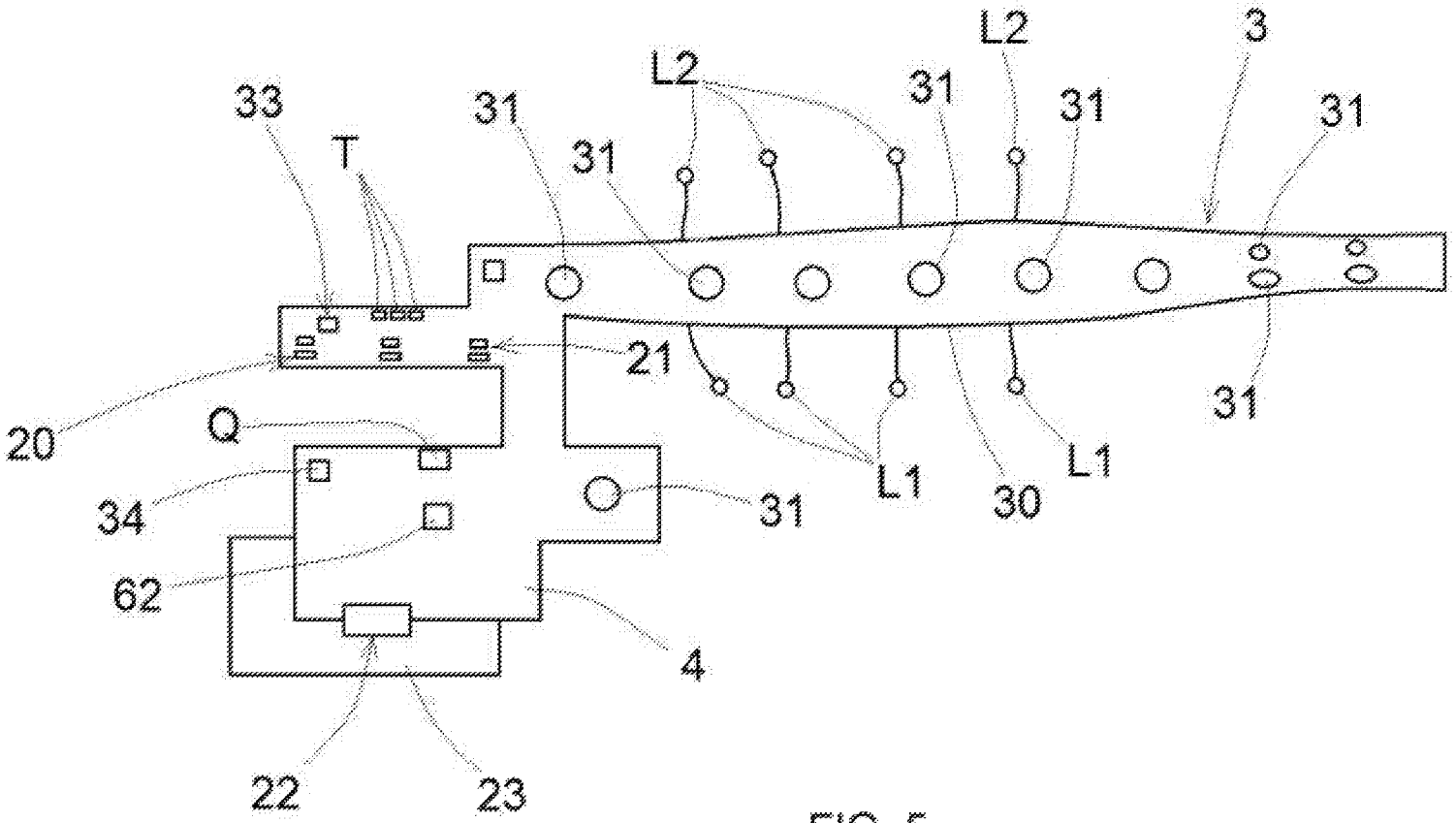
FIG. 5 is a top view of power, control and sensor units for the instruments of the present invention.

In FIGS. 1, 2 and 5, a musical instrument related to the present invention is described, indicated by the reference number (100).

The musical instrument (100), according to the present invention, includes a cylindrical empty body (1), which has a bottom part and a top part resembling a beak (mouthpiece) where the player put his lips.

The body (1) includes an air inlet opening (12) that is positioned on the top part (1) and an air outlet (14) at the bottom part of the instrument which is in communication with the opening (12) to allow the air exiting from the instrument body (1).

The air outlet (14) is formed by a lower blade, technically called a 'labium' which initiates the air vibration in the body (1). This vibration generates the emission of a sound.

The body (1) includes a number of holes (10), positioned below the air outlet (14) and able to be closed or opened with the fingers of the player in order to set a particular note. In particular, the body (1) includes a row of top holes (10) and a single bottom hole (10).

Referencing FIG. 5, the musical instrument (100) includes a group of sensors (3) and a printed circuit board (30) which support the sensors (3). Preferably, the aforementioned printed circuit board could be made flexible to adapt to the internal shape of the body (1).

Also referencing FIG. 5, the sensor group (3) includes proximity sensors (31) placed near the holes (10) to detect the presence of the fingers. In other words, those proximity sensors (31) detects if holes (10) are blocked or not by the player.

Preferably, those proximity sensors (31) are embodied as capacitive sensors.

Advantageously, on some of the holes (10) is possible to place two or more proximity sensors (31) to detect two or more player's finger positions.

The sensor group (3) also includes a barometric pressure sensor (33), preferably placed inside of the body (1) in proximity of the mouthpiece (12) to detect the pressure of the air that is blown inside the instrument's body (1).

Advantageously, the sensor group (3) includes a position sensor (34) that can detect the space position and movements of the body (1). In particular, this sensor can be an accelerometer.

The musical instrument (100) includes a control unit (4) electrically connected to the sensor group (3) to receive sensor's information. In particular, the printed circuit board (30) hosts electrical tracks connected to the sensor group (3) and to the control unit (4) to transmit information to the sensor group (3) and to the control unit (4).

The control unit (4) has a microcontroller placed in the body (1), near the air input opening (12). Advantageously, the position sensor (34) is placed on the control unit (4).

The musical instrument (100) includes a sound generator (Q) which is electrically connected to the control unit (4). The sound generator (Q) is preferably placed in the aforementioned control unit (4).

This sound generator (Q) consists in an integrated circuit capable of generating and synthesizing following the signals coming from the control unit (4).

The sound generator (Q) could be software programmable to emulate several tones, timbres and different musical instruments.

The musical instrument (100) also includes an acoustic device (Q) which converts the synthesized information coming from the sound generator (Q) into acoustic waves. This device could be a speaker, an earpiece, or other similar devices.

The musical instrument (100) includes a power supply (2) connected to the sensor group (3) and to the control unit (4). The mentioned power supply (2) includes a battery (23). Advantageously the battery (23) is a Lithium Ion technology.

The power supply (2) also includes a micro USB port (22), where the user will plug the USB cable to recharge the battery (23).

Optionally, the power supply (2) may include means and devices on the body (1) to generate electrical energy and recharge, also partially, the battery (23).

The power generating devices could be, as an example, micro photovoltaic panels, piezoelectric generators and other type of energy harvesting technologies, which may improve the duration of the battery (23) without using an external source.

The power supply (2) also includes buttons (20) to turn the product on an off, and to configure the power supply (2). The buttons (20) are placed near the air opening (12) of the body (1).

The power supply (2) also includes LED light sources (21) connected to the control unit (4) to visually show the status of the instrument. For example, depending on which LEDs (21) are lit, the LEDs may show the operating status of the instrument (100), the status of the battery (23), the operating mode, the musical tempo etc.

Figure 4:
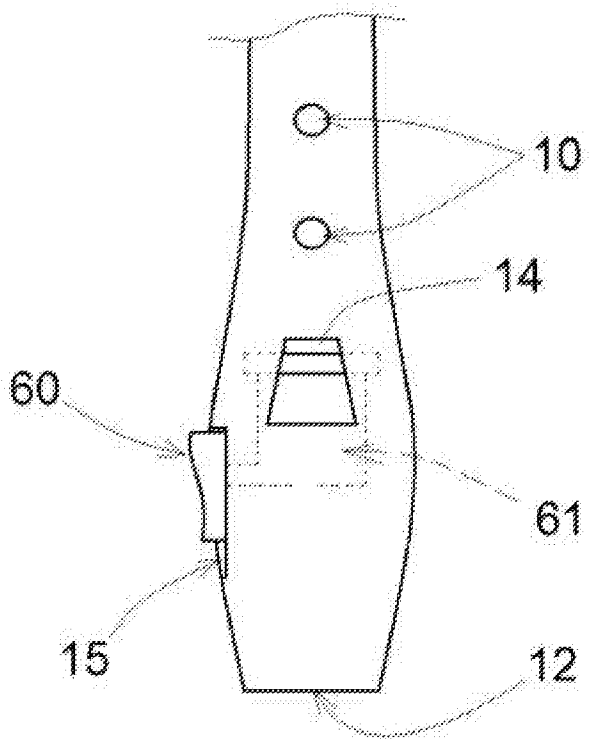
FIG. 4 is analogous to FIG. 3 but with the labium opening partially closed.
Figure 3:
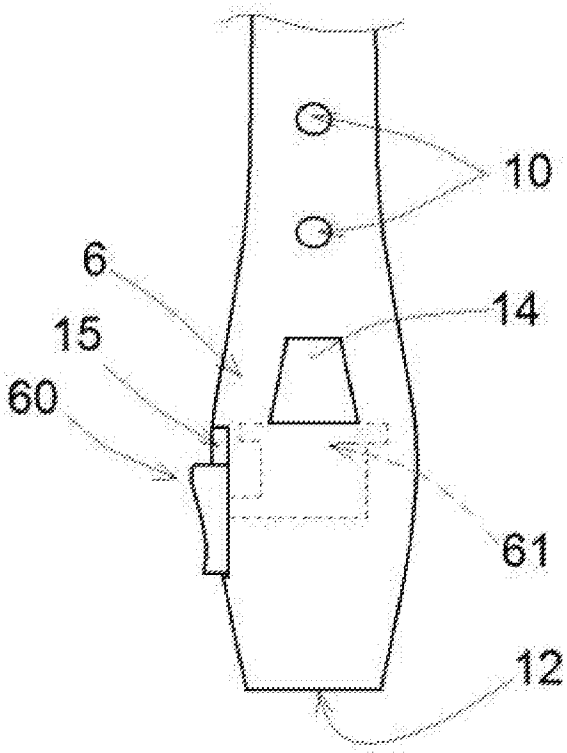
FIG. 3 is a partial top view of the instrument of FIG. 1 with the labium opening open.

Referencing FIGS. 3 and 4, the musical instrument (100) includes a muting plug or device (6) mounted near the air outlet (14) of the body (1) to partially or totally close the air outlet (14). In particular, the body (1) includes an hole (15) and the muting plug or device (6) including a sliding tab (60) external to the body (1) and mounted near the hole (15). The muting device (6) also includes a plastic plug (61) which is fixed to the sliding tab (60).

The sliding tab (60) is manually moved by the player, changing the position from an open hole (14), visible in picture 3, to a situation where of the hole (14) of the body (1) is closed partially or totally by the plastic plug (61), visible in picture 4. In this situation no sounds are generated by the musical instrument (100).

Advantageously, the muting plug or device (6) could include a detection sensor (62), visible in picture 5, which can tell the control unit (4) whenever the air outlet (14) is open or closed by the plastic plug (61) of the muting device (6).

As an example, the detection sensor (62) may be implemented as a proximity sensor which detects the sliding tab position (60) in the hole (15) and consequently, detects if the air outlet (14) is open or closed.

The detection sensor (62) is connected to the control unit (4) to transmit the open or closed information to the control unit (4). When the air outlet (14) is closed, the musical instrument (100) may be used without emitting sounds through the vibration of the air which exit from the air outlet (14) hence utilized in full 'digital' mode, avoiding the emission of sounds in presence of people which are not interested or may be annoyed by the music.

Referencing FIG. 2, the body (1) advantageously includes a planar support surface (18) which allows the body (1) to be stably positioned on an horizontal plane.

Preferably, this planar support surface (18) is placed near the air inlet (12), and may coincide with a plastic separator which delimitate the battery space (23). In particular, the planar support surface is machined at the opposite side of the body (1) where the air outlet (14) is located.

Referencing FIGS. 1 and 5, the musical instrument (100) includes two LEDs (L1, L2) for each body hole (10), where a first LED (L1) placed on one side of the hole (10) and a second one (L2) placed on the opposite side of the hole (10). Each LED (L1, L2) is electrically connected to the control unit (4).

LEDs (L1, L2) may be used to indicate the correctness of an interpretation, or the holes (10) that the player have to close, to aid the player in the correct execution of the sheet music.

Placing the LEDs (L1, L2) on both sides of the holes (10) allows the aforementioned functionalities (correctness and hole indication) of the musical instrument (100) to remain valid even in the case of a left-handed player.

Figure 6:
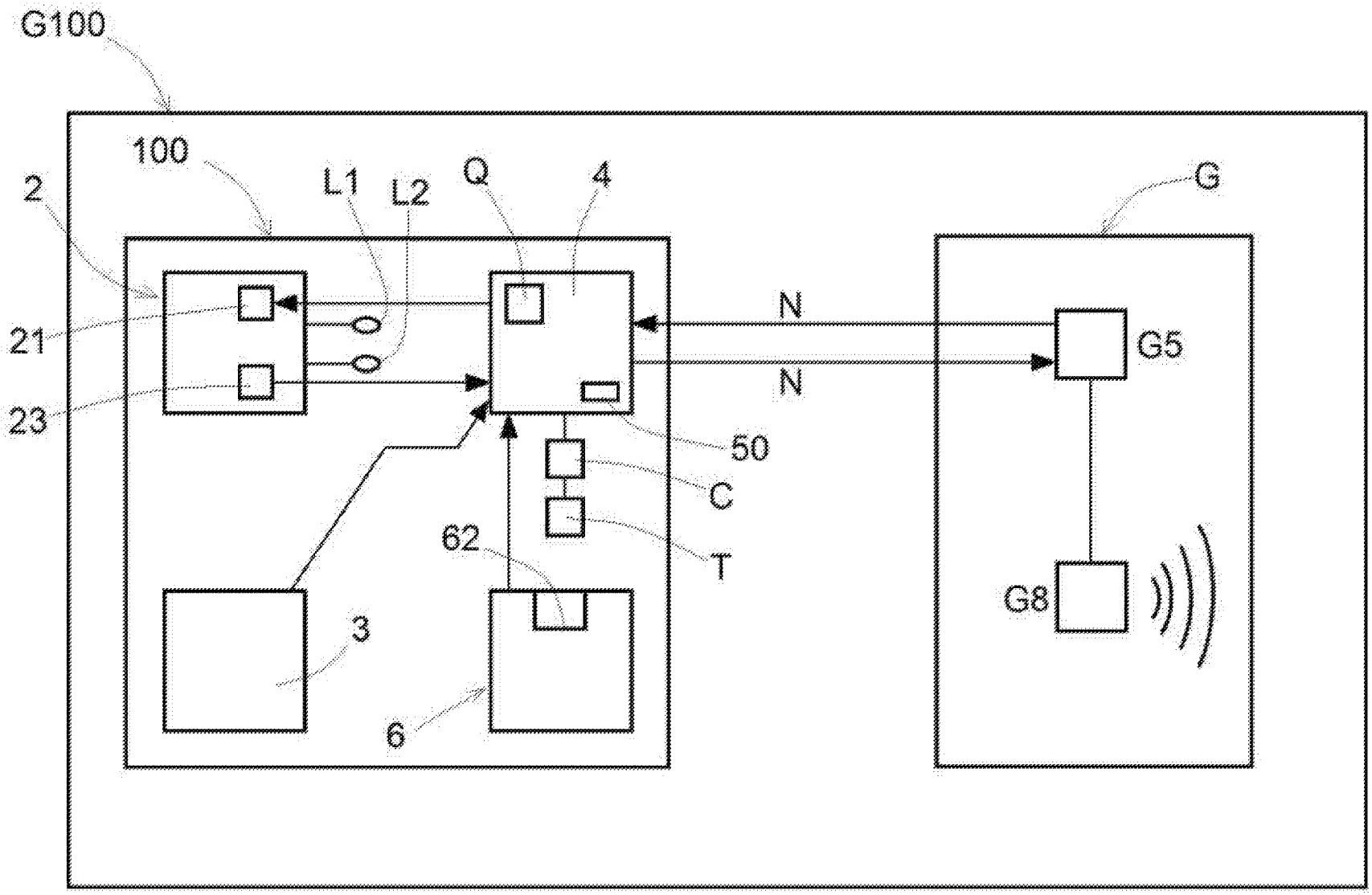
FIG. 6 is a schematic group view including the instrument and a smart device.

Referencing FIGS. 1 and 6, the musical instrument (100) includes a number of buttons (T) that the player can press, and a commutator (C) connected to the mentioned buttons (T).

Every button (T) allows to choose one of the ways in which the instrument (100) can be played. Commutator (C) is electrically connected to the control unit (4) to transmit information on which button (T) is pressed, in order to define which is the usage of the instrument (100).

The user can couple/pair the musical instrument (100) with a smart device (G), realizing a instrument/smart device group (G100).

With reference to FIG. 6, both the musical instrument (100) and the smart device (G) include a transmitter/receiver unit (from now on: transceiver) (50, G5) mutually connected to exchange information. The transceiver (50) of the musical instrument (100) is electrically connected to the mentioned control unit (4).

The smart device (G) includes a sound emitter (G8) to produce the sound defined by the musical instrument (100) based on the information (N) received from the musical instrument (100).

The transceiver (50) of the instrument (100) and the transceiver (G5) of the smart device (G) include a wireless module.

Optionally, the information (N) transmitted by the transceivers (50, G5) is of the MIDI standard type. The MIDI standard protocol allows to play any kind of virtual instrument without having to configure in particular ways the smart device (G).

Alternatively, is possible to use other protocols, including proprietary protocols.

Starting from the previous description, in the remainder of the document are described the many ways in which the musical instrument (100) can be used according to the invention.

In the first mode of use, called 'classic', the instrument (100) is played like a regular wind instrument, blowing into the mouthpiece without having to turn on the sensor groups (3).

The instrument (100) can also be used in a so called 'digital' mode, where the sensor group (3) is turned on, and the air outlet (14) is closed.

If the musical instrument (100) is placed into the 'digital' mode, pressing the mode buttons (T), the mentioned instrument (100) can be used in alternate modes, can play other instrument's sounds differently from the musical instrument.

When put in 'digital' mode, the musical instrument (100) can be used in several different ways. The first usage mode is the 'digital recorder', where the player blows air into the mouthpiece of the instrument (100), the barometric pressure sensor (33) detect the change in pressure, and the proximity sensors (31) detect the finger position, locating the note with a certain intensity.

The located note, along with its measured intensity, can be directly synthesized by the sound generator (Q) and played by the acoustic driver, or, if the musical instrument (100) is wirelessly connected with the smart device (G), can be sent as a MIDI information (N) to the smart device (G). The smart device (G) then, plays the note with the measured intensity.

It is specified that both the smart device (G) and the sound generator (Q) put in the hand of the player a timbric palette coming from many different musical instruments, allowing the player to hear a different sound with respect to the musical instrument (100) original one.

Alternatively, the musical instrument (100) can also be handled like an orchestra director's baton.

Moving the instrument (100) in the air, through the information received from the position sensor (34), which detects position, acceleration and speed of the body (1) of the instrument (100) is possible to speed up or slow down the execution of a musical track, or to change an arrangement depending on how quick the instrument (100) is moved through the air.

Keeping the handling of the instrument like a drum stick, it is also possible to play the 'air drum' exploiting the information coming from the position sensor (34).

Furthermore, the musical instrument (100) could be seated horizontally on a plane, thanks to the planar surface support (18). This way the musical instrument (100) can be used as a 'keyboard', with holes (10) corresponding to the keys of a "piano keyboard".

It is specified that, in all of the mentioned scenarios, the information coming from the sensor group (3) could trigger both internally generated sounds, with sound generator (Q) and amplified by the acoustic device (Q), or sending the note information (N) to a smart device (G), externally generated.

Furthermore, the smart device (G) can include a software which implement a 'looper' function, in other words a software which can play multiple tracks generated by the same instrument (100), in a way where is possible to layer tracks made with different sounds to create a complete arrangement of virtual instruments.

Again, the smart device (G) may include a 'correction' software which interprets and improves the finger position of a player on the instrument (100) in order to obtain pleasing melodies without out of tunes and/or false notes. This peculiarity is particularly advantageous in presence of very small children or people with minor motion disabilities.

The instrument/smart device group (G100) may be used at school during music classes. For example, the instrument (100) of every student is connected to a single smart device (G) managed by a teacher, which can check in realtime the finger position of every student.

The smart device (G) can be configured such as a different sound is associated to every student. In this example, even if the student have the same instrument (100), the sound effect could be that one of a real orchestra playing.

The teacher, using the smart device (G), apart from associating different timbre to different students, may also isolate some student or student's sections, record the execution etc.

Furthermore, the smart device (G) may connect to an IWB (Interactive Whiteboard), where the score for different 'sections' of players are showed, alongside with the correct execution in realtime.

In a preferred embodiment of the invention, the instrument/smart device group (G100) may be connected to a server and be part of an Information Technology system (S).

Figure 7:
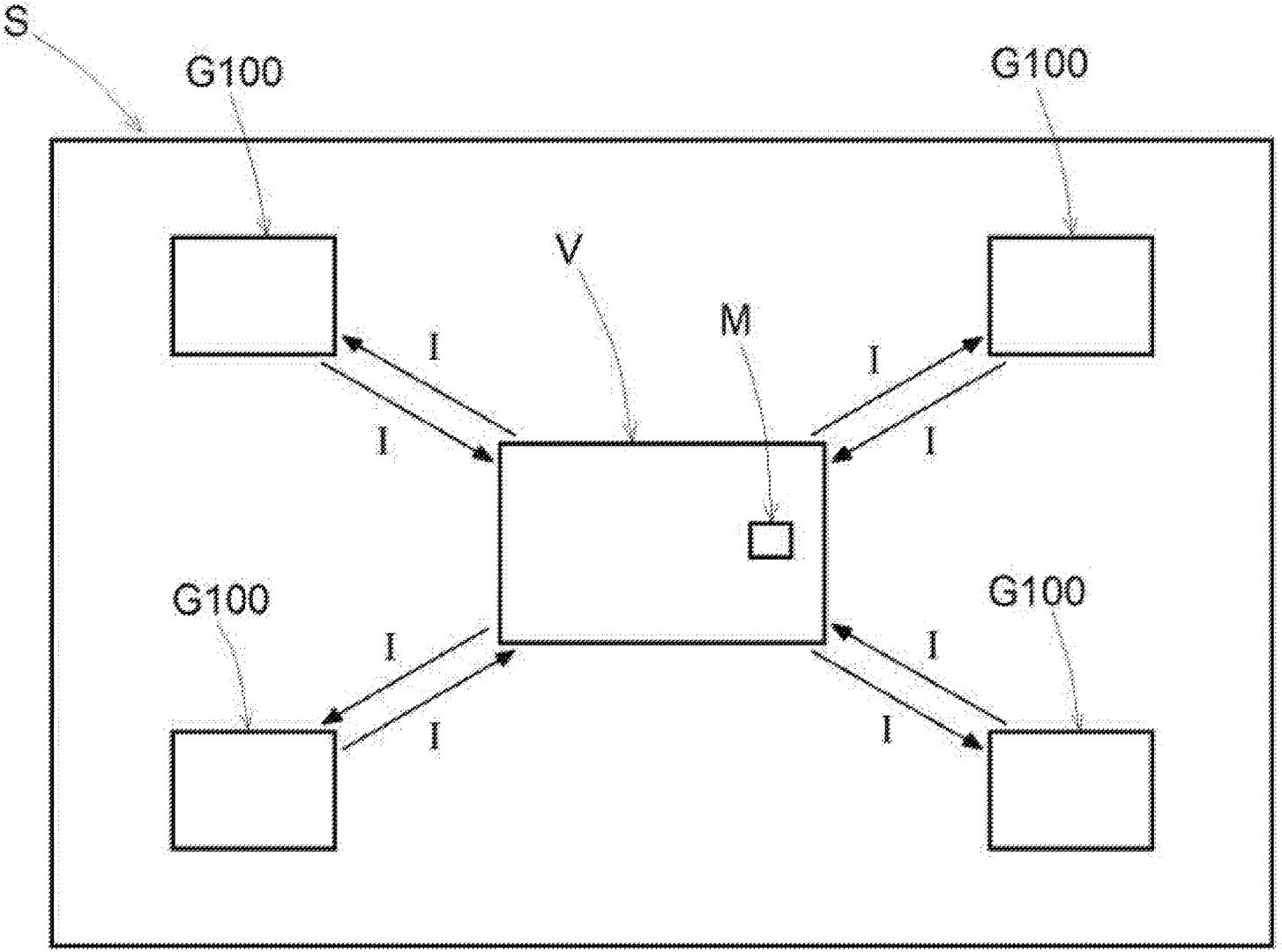
FIG. 7 is a schematic group view which includes an information technology system including a server and a quantity of instrument-smart device groups.

Precisely, referencing FIG. 7, the Information Technology system (S) includes a server (V), which contains a memory (M), one or more instrument/smart device groups (G100). The smart device (G) of every instrument/smart device group (G100), is connected to the server (V) through a telecommunication network.

Every smart device (G) send to the server (V) information (I) and receive from the cited server (V), information (I) coming from one or more smart devices (G) belonging to one or more instrument/smart device groups (G100).

The information technology system (S) allows to interconnect several smart devices (G), belonging to geographically dislocated instrument/smart device groups (G100), at the same time.

The Information Technology System (S) which includes a number of instrument/smart device groups (G100), may be used in several different modes that we describe herein:

As a first installment, the information technology system (S) could be used to carry on remotely held musical education lessons, both in real-time and off-line.

Moreover, the information technology system (S) can be used to load and save tracks and songs that are resident in the server (V) memory (M). Those tracks and songs may be used to practice the musical instrument (100).

One more potential application, thanks to the connection of more than one instrument/smart device groups (G100) to the information technology system (S), is to implement a 'de-localized virtual orchestra'. Synchronizing all the smart devices (G) of the instrument/smart device groups (G100), each participant, in addition to his own generated music, can hear the musical execution of other users.

Following the description of the usage modes, the mentioned musical instrument (100) presents the following advantages:

it's simple and economic;

it's versatile; in fact it can be used, other than a wind instrument, also as other type of musical instruments, like keyboard based ones and percussive;

allows to hear the sound of several different musical instruments;

it is suited to a very large consumer base, from children to adults;

it can be produced on a large scale;

it can be connected to a smart device (G) and to an information technology system (S) allowing the user to have advanced functionalities linked to the world of connectivity, social platforms and remote teaching.

The present embodiment of the invention may be implemented in many detail variations and modifications, from a specialized engineer, while keeping relevant the perimeter of the invention which is explained in the attached claims.

As an example, even in the figures is depicted a recorder, the musical instrument (100) could also be a transverse flute, a saxophone or another wind instrument.

I claim:

1. A musical instrument comprising:

a hollow body having an air inlet and an air outlet and a number of holes, the air inlet adapted to allow a player to blow air into said hollow body, the air outlet adapted to allow air to at least partially exit said hollow body, the number of holes adapted to be closed by the player;

a group of sensors comprising a proximity sensor positioned adjacent to the number of holes so as to detect when a hole of the number of holes is open or closed, said group of sensors further comprising a barometric pressure sensor positioned on or in said hollow body adjacent the air inlet so as to measure a pressure of the air that is blown into the air inlet;

a control unit electrically connected to said group of sensors to receive information from said group of sensors; and a power supply unit connected to said group of sensors and to said control unit so as to supply power to said group of sensors and to said control unit.

2. The musical instrument of claim 1, further comprising:

a sound generator connected to said control unit so as to synthesize and play sounds relating to the received information from said control unit, said power supply unit being connected to said sound generator to supply energy to be used by said sound generator.

3. The musical instrument of claim 1, wherein said group of sensors comprises:

a position sensor that detects a position of said hollow body.

4. The musical instrument of claim 3, wherein said sensor comprises:

an acceleration sensor that detects accelerations applied to said hollow body.

5. The musical instrument of claim 1, wherein said proximity sensor is a capacitive sensor.

6. The musical instrument of claim 1, wherein said proximity sensor comprises a plurality of pairs of proximity sensors that are respectively positioned at each hole of the number of holes.

7. The musical instrument of claim 1, further comprising:

a printed circuit board positioned in said hollow body so as to support said group of sensors, said printed circuit board having tracks connected to said group of sensors and to said control unit so as to transmit information from said group of sensors to said control unit.

8. The musical instrument of claim 1, further comprising:

a muting plug device mounted near the air outlet of said hollow body so as to partially close the air outlet.

9. The musical instrument of claim 8, wherein said hollow body has a slot, said muting plug device comprising:

a sliding tab positioned outside of said hollow body and mounted so as to slide in the slot; and a muting plug joined to said sliding tab so as to translate from an open position to a closed position, the open position opening the air outlet, the closed position closing the air outlet.

10. A musical instrument comprising:

a hollow body having an air inlet and an air outlet and a number of holes, the air inlet adapted to allow a player to blow air into said hollow body, the air outlet adapted to allow air to at least partially exit said hollow body, the number of holes adapted to be closed by the player;

a group of sensors comprising a proximity sensor positioned adjacent to the number of holes so as to detect whenever when a hole of the number of holes is open or closed;

a control unit electrically connected to said group of sensors to receive information from said group of sensors;

a power supply unit connected to said group of sensors and to said control unit so as to supply power to said group of sensors and to said control unit; and a muting plug device mounted adjacent to the air outlet of said hollow body so as to at least partially close the air outlet, said muting plug device having a detection sensor that detects an opening of a closing of the air outlet, the detection sensor being electrically connected to said control unit so as to transmit information as to an open status or a closed status of the air outlet to said control unit.

11. The musical instrument of claim 10, wherein the hollow body has a planar support surface that allows said hollow body to be stably horizontally positioned on a planar surface.

12. The musical instrument of claim 10, further comprising:

at least one LED for each hole of the number of holes, the at least one LED positioned on said hollow body in proximity to the hole and being electrically connected to said control unit.

13. The musical instrument of claim 12, wherein said at least one LED comprises a first LED and a second LED, the first and second LEDs being positioned laterally relative to the hole, the first LED positioned on one side of the hole, the second LED positioned on an opposite side of the hole.

14. A musical instrument comprising:

a hollow body having an air inlet and an air outlet and a number of holes, the air inlet adapted to allow a player to blow air into said hollow body, the air outlet adapted to allow air to at least partially exit said hollow body, the number of holes adapted to be closed by the player;

a group of sensors comprising a proximity sensor positioned adjacent to the number of holes so as to detect whenever when a hole of the number of holes is open or closed;

a control unit electrically connected to said group of sensors to receive information from said group of sensors;

a power supply unit connected to said group of sensors and to said control unit so as to supply power to said group of sensors and to said control unit;

a plurality of buttons that can be pressed by the player; and a commutator driven by said plurality of buttons, said commutator being electrically connected to said control unit so as to transmit information relative to a mode of use of the musical instrument.

15. The musical instrument of claim 14, wherein said power supply unit comprises a battery positioned in said hollow body and a switch that turns the power supply unit on and off.

16. The musical instrument of claim 15, wherein said power supply unit has a micro-USB port positioned on said hollow body so as to allow the battery to be recharged.

17. The musical instrument of claim 15, wherein said power supply unit has an energy generation device positioned on said hollow body so as to at least partially recharge the battery.

18. The musical instrument of claim 14, further comprising:

a smart device; and transceiver connected between the musical instrument and said sensor device so as to exchange sound and note information, said smart device having a sound emitter that plays the sound information sent by the musical instrument, said transceiver being connected to said control unit.

19. The musical instrument of claim 18, wherein said transceiver has a wireless module.

20. The musical instrument of claim 18, wherein the sound and note information is MIDI standard information.

21. The musical instrument of claim 18, further comprising:

a server having a memory unit, said smart device being connected to said server through a telecommunication network, said smart device sends the sound information to said server.

* * * * *